US009514676B2

(12) United States Patent
Wu et al.

(10) Patent No.: US 9,514,676 B2
(45) Date of Patent: Dec. 6, 2016

(54) PIXEL CIRCUIT AND DRIVING METHOD THEREOF AND DISPLAY APPARATUS

(71) Applicant: BOE TECHNOLOGY GROUP CO., LTD., Beijing (CN)

(72) Inventors: Zhongyuan Wu, Beijing (CN); Baojiang Zhang, Beijing (CN); Liye Duan, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 14/426,803

(22) PCT Filed: Apr. 29, 2014

(86) PCT No.: PCT/CN2014/076485

§ 371 (c)(1),
(2) Date: Mar. 9, 2015

(87) PCT Pub. No.: WO2015/085702

PCT Pub. Date: Jun. 18, 2015

(65) Prior Publication Data

US 2015/0339973 A1 Nov. 26, 2015

(30) Foreign Application Priority Data

Dec. 12, 2013 (CN) ..... 2013 1 0683964

(51) Int. Cl.
*G09G 3/32* (2016.01)

(52) U.S. Cl.
CPC ..... *G09G 3/3225* (2013.01); *G09G 3/3233* (2013.01); *G09G 2300/0814* (2013.01);
(Continued)

(58) Field of Classification Search
CPC ..... G09G 3/3225; G09G 3/3233; G09G 2300/0814;G09G 2300/0819; G09G 2300/0842; G09G 2300/0861; G09G 2310/0251; G09G 2320/0233; G09G 2320/0257; G09G 2320/043; G09G 2320/045
See application file for complete search history.

(56) References Cited

U.S. PATENT DOCUMENTS 6,611,107 B2 8/2003 Mikami et al.
7,456,810 B2 11/2008 Kimura
(Continued)

FOREIGN PATENT DOCUMENTS

CN 1427388 A 7/2003
CN 101136173 A 3/2008
(Continued)

OTHER PUBLICATIONS

Notice of Patent Grant Notification for Chinese Patent Application No. 201310683964.6, issued on Jul. 31, 2015 in Chinese with an English translation.
(Continued)

*Primary Examiner* — Lun-Yi Lao
*Assistant Examiner* — Jarurat Suteerawongsa
(74) *Attorney, Agent, or Firm* — Collard & Roe, P.C.

(57) ABSTRACT

Provided are a pixel circuit and driving method thereof and a display apparatus. The pixel circuit comprises a first transistor (T1), a second transistor (T2), a third transistor (T3), a storage capacitor (C1), a parasitic capacitor (C2) and a light emitting device (L). A first electrode of the first transistor (T1) is connected to a first power source signal terminal, and its second electrode is connected to a first electrode of the third transistor (T3); the gate of the second transistor (T2) is connected to a first control signal terminal (S1), its first electrode is connected to a data signal terminal (DATA), and its second electrode is connected to the gate of
(Continued)

the first transistor (T1); the gate of the third transistor (T3) is connected to a second control signal terminal (S2), and its second electrode is connected to one terminal of the light emitting device (L); one terminal of the storage capacitor (C1) is connected to the gate of the first transistor (T1), and the other terminal of the storage capacitor is connected to one terminal of the light emitting device (L); one terminal of the parasitic capacitor (C2) is connected to one terminal of the light emitting device (L), and the other terminal of the parasitic capacitor (C2) is connected to the other terminal of the light emitting device (L); and the other terminal of the light emitting device (L) is also connected to a second power source signal terminal (ELVSS). The pixel circuit can effectively compensate for the threshold voltage shift of the TFTs and improve the display effect.

6 Claims, 6 Drawing Sheets

(52) U.S. Cl.
CPC ..... *G09G 2300/0819* (2013.01); *G09G 2300/0842* (2013.01); *G09G 2300/0861* (2013.01); *G09G 2310/0251* (2013.01); *G09G 2320/0233* (2013.01); *G09G 2320/0257* (2013.01); *G09G 2320/043* (2013.01); *G09G 2320/045* (2013.01)

(56) References Cited

U.S. PATENT DOCUMENTS

| | | | | |
|---|---|---|---|---|
| 7,612,749 | B2 | 11/2009 | Libsch et al. | |
| 8,310,416 | B2 | 11/2012 | Yatabe et al. | |
| 8,410,999 | B2 | 4/2013 | Kang et al. | |
| 8,648,840 | B2 | 2/2014 | Uchino et al. | |
| 8,730,133 | B2 | 5/2014 | Tanikame | |
| 2003/0111966 | A1* | 6/2003 | Mikami | G09G 3/3233 315/169.3 |
| 2008/0048949 | A1 | 2/2008 | Kim | |
| 2009/0135112 | A1 | 5/2009 | Uchino et al. | |
| 2010/0220091 | A1 | 9/2010 | Choi | |
| 2013/0063041 | A1 | 3/2013 | Kimura | |
| 2014/0347401 | A1* | 11/2014 | Hwang | G09G 3/3233 345/690 |

FOREIGN PATENT DOCUMENTS

| | | | |
|---|---|---|---|
| CN | 101136180 | A | 3/2008 |
| CN | 101266753 | A | 9/2008 |
| CN | 101447169 | A | 6/2009 |
| CN | 101471028 | A | 7/2009 |
| CN | 101656047 | A | 2/2010 |
| CN | 103680406 | A | 3/2014 |
| JP | 2005352411 | A | 12/2005 |
| JP | 2010117725 | A | 5/2010 |

OTHER PUBLICATIONS

Issued Patent for Chinese Patent Application No. 201310683964.6 dated Sep. 9, 2015 with a listing of the Chinese granted claims with an English translation.

English translation of the International Search Report of PCT/CN2014/076485, mailed Sep. 23, 2014.

English translation of the Written Opinion of the International Searching Authority of PCT/CN2014/076485, mailed Sep. 23, 2014.

First Chinese Office Action of Chinese Application No. 201310683964.6, mailed Oct. 30, 2014 with English translation.

Second Chinese Office Action of Chinese Application No. 201310683964.6, mailed Apr. 29, 2015 with English translation.

International Search Report and Written Opinion of the International Searching Authority with Notice of Transmittal of the International Search Report and Written Opinion of PCT/CN2014/076485 in Chinese, mailed Apr. 29, 2014.

* cited by examiner

PIXEL CIRCUIT AND DRIVING METHOD THEREOF AND DISPLAY APPARATUS

CROSS REFERENCE TO RELATED APPLICATIONS

This application is the National Stage of PCT/CN2014/076485 filed on Apr. 29, 2014, which claims priority under 35 U.S.C. §119 of Chinese Application No. 201310683964.6 filed on Dec. 12, 2013, the disclosure of which is incorporated by reference.

TECHNICAL FIELD OF THE DISCLOSURE

The present disclosure relates to the field of display technologies, and specifically, to a pixel circuit and driving method thereof and a display apparatus.

BACKGROUND

The OLED (Organic Light Emitting Diode) as a type of current-type light emitting devices is more and more applied to high performance display areas due to its characteristics such as self light emitting, fast response, wide angle of view, capability of being fabricated on a flexible substrate, and so on. The OLED can be classified into two kinds in terms of driving manner, which are PMOLED (Passive Matrix Driving OLED) and AMOLED (Active Matrix Driving OLED). For the conventional PMOLED, the driving time for a single pixel usually needs to be reduced with the increase of the size of the display apparatus; therefore, the transient current needs to be increased, causing dramatic increase of power consumption. However, in the AMOLED technology, current is input into each OLED through progressive scanning by a TFT (Thin Film Transistor) switch circuit, which can solve the above problems well.

In existing AMOLED panels, the TFT switch circuits mostly use low temperature poly silicon (LTPS) TFTs or oxide TFTs. In contrast to a normal amorphous-Si TFT, the LTPS TFT and the Oxide TFT have higher mobility and more stable characteristics, and are more suitable to be applied in the AMOLED display. However, due to the limitation of crystallization process and fabrication level, TFT switch circuits fabricated on a large area glass substrate usually show nonuniformity in electrical parameters such as threshold voltage, mobility or the like, such that the threshold voltages of the respective TFTs deviate differently, which results in current difference and brightness difference of the OLED display devices that can be perceived by human eyes. In addition, the threshold voltage of the TFT will shift under long time pressure and high temperature. The threshold shift amount of TFTs in different parts of the panel is different due to different display pictures, causing difference in display brightness. Because such a difference is related to the image displayed previously, it is usually presented as the afterimage phenomenon.

SUMMARY

Embodiments of the present disclosure provide a pixel circuit and driving method thereof and a display apparatus, which can effectively compensate for the threshold voltage shift of TFTs, improve the uniformity of the light emitting brightness of the display apparatus, and improve the display effect.

In order to solve the above problems, embodiments of the present disclosure can adopt the following technical solutions.

According to one aspect of embodiments of the present disclosure, there is provided a pixel circuit comprising a first transistor, a second transistor, a third transistor, a storage capacitor, a parasitic capacitor and a light emitting device.

A first electrode of the first transistor is connected to a first power source signal terminal, and a second electrode of the first transistor is connected to a first electrode of the third transistor.

A gate of the second transistor is connected to a first control signal terminal, a first electrode of the second transistor is connected to a data signal terminal, and a second electrode of the second transistor is connected to a gate of the first transistor.

A gate of the third transistor is connected to a second control signal terminal, and a second electrode of the third transistor is connected to one terminal of the light emitting device.

One terminal of the storage capacitor is connected to the gate of the first transistor, and the other terminal of the storage capacitor is connected to one terminal of the light emitting device.

One terminal of the parasitic capacitor is connected to one terminal of the light emitting device, and the other terminal of the parasitic capacitor is connected to the other terminal of the light emitting device.

The other terminal of the light emitting device is also connected to a second power source signal terminal.

According to another aspect of embodiments of the present disclosure, there is provided a display apparatus comprising the pixel circuit as described in the above.

According to yet another aspect of embodiments of the present disclosure, there is provided the pixel circuit driving method for driving a pixel circuit as described in the above, comprising:

turning on the first transistor, the second transistor and the third transistor, inputting a reset signal into the data signal terminal, and inputting a first voltage into the first power source signal terminal to control the light emitting device to be in an OFF state;

keeping the first transistor, the second transistor and the third transistor being turned on, and inputting a second voltage into the first power source signal terminal to pre-charge one terminal of the light emitting device;

turning off the third transistor, inputting a data signal into the data signal terminal to make the pixel circuit perform data writing; and turning off the second transistor, turning on the third transistor, and driving the light emitting device to emit light by the current flowing through the first transistor and the third transistor.

The pixel circuit and driving method thereof and the display apparatus provided by embodiments of the present disclosure enable the current flowing through the transistors and used for driving the light emitting devices is irrelevant to the threshold voltage of the transistors by switching and charging/discharging control of the circuit through a plurality of transistors and capacitors, thereby compensating for the difference in current flowing through the light emitting devices due to inconformity or deviation of threshold voltages of the transistors, improving the uniformity of the light emitting brightness of the display apparatus, and dramatically raising the display effect. In addition, since the pixel circuit of such a structure has a simple structure and small amount of transistors, area of the light blocking region overlaying transistors can be reduced, and thus the aperture ratio of the display apparatus can be effectively increased.

BRIEF DESCRIPTION OF THE DRAWINGS

In order to more clearly explain the technical solutions of the embodiments of the present disclosure, the figures to be used in the description of the embodiments will be briefly introduced in the following.

DETAILED DESCRIPTION

Clear and complete description will be made to the technical solutions in embodiments of the present disclosure in connection with the figures below. Obviously, the described embodiments are only part of embodiments of the present disclosure, but not all of them. Based on the embodiments in the present disclosure, all other embodiments obtained by those skilled in the art without creative work fall within the protection scope of the present disclosure.

Figure 1:
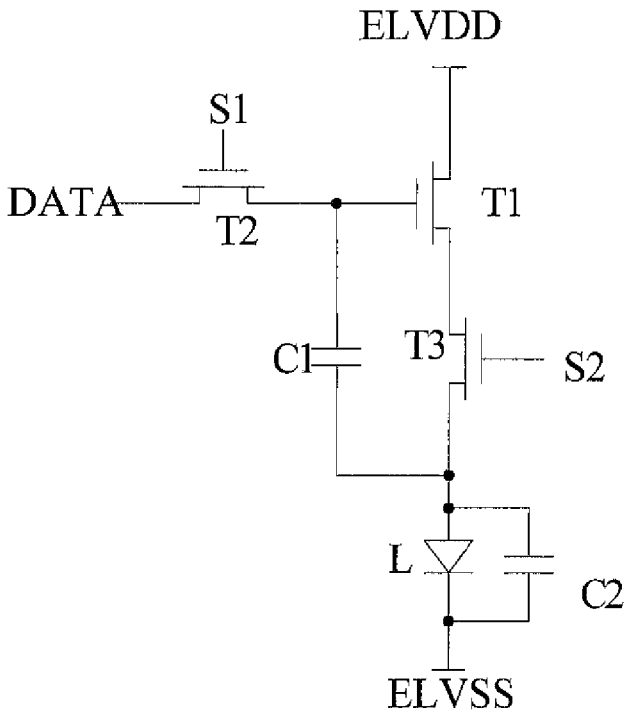
FIG. 1 is a schematic diagram of connection structure of a pixel circuit according to an embodiment of the present disclosure.

FIG. 1 is a schematic diagram of connection structure of a pixel circuit according to an embodiment of the present disclosure. As shown in FIG. 1, the pixel circuit comprises a first transistor T1, a second transistor T2, a third transistor T3, a storage capacitor C1, a parasitic capacitor C2 and a light emitting device L.

A first electrode of the first transistor T1 is connected to a first power source signal terminal ELVDD, and a second electrode of the first transistor T1 is connected to a first electrode of the third transistor T3.

A gate of the second transistor T2 is connected to a first control signal terminal S1, a first electrode of the second transistor T2 is connected to a data signal terminal DATA, and a second electrode of the second transistor T2 is connected to a gate of the first transistor T1.

A gate of the third transistor T3 is connected to a second control signal terminal S2, and a second electrode of the third transistor T3 is connected to one terminal of the light emitting device L.

One terminal of the storage capacitor C1 is connected to the gate of the first transistor T1, and the other terminal of the storage capacitor C1 is connected to one terminal of the light emitting device L.

One terminal of the parasitic capacitor C2 is connected to one terminal of the light emitting device L, and the other terminal of the parasitic capacitor C2 is connected to the other terminal of the light emitting device L.

The other terminal of the light emitting device L is also connected to a second power source signal terminal ELVSS.

It should be noted that the light emitting device L in embodiments of the present disclosure can be various normal current-driving light emitting devices including LED (Light Emitting Diode) or OLED (Organic Light Emitting Diode). In the embodiment of the present disclosure, description is made by taking the OLED as an example.

In the pixel circuit of the embodiment of the present disclosure, it is possible to make the current flowing through the transistors and used for driving the light emitting device irrelevant to the threshold voltage of the transistors by switching and charging/discharging control of the circuit through a plurality of transistors and capacitors, thereby compensating for the difference in current flowing through the light emitting devices due to inconformity or deviation of threshold voltages of the transistors, improving the uniformity of the light emitting brightness of the display apparatus, and dramatically raising the display effect. In addition, since the pixel circuit of such a structure has a simple structure and small amount of transistors, area of the light blocking region overlaying transistors can be reduced, and thus the aperture ratio of the display apparatus can be effectively increased.

In the circuit, the first transistor T1, the second transistor T2 and the third transistor T3 can be all N type transistors; or the first transistor T1, the second transistor T2 and the third transistor T3 are all P type transistors.

In the following, the operation procedure of the pixel circuit shown in FIG. 1 is described by taking the first transistor T1, the second transistor T2 and the third transistor T3 being all N type transistors as an example. Specifically, during the operation of the pixel circuit shown in FIG. 1, its operation procedure can be divided into four phases which are the reset phase, the compensation phase, the data writing phase and the light emitting phase.

Figure 2:
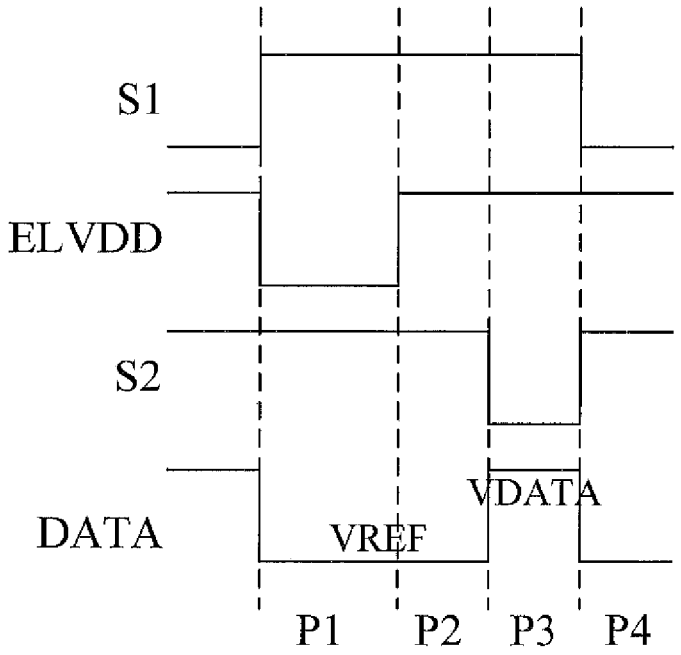
FIG. 2 is a timing diagram of each signal line for driving the pixel circuit shown in FIG. 1.

FIG. 2 is a timing diagram of various signal lines during the operation procedure of the pixel circuit shown in FIG. 1. As shown in FIG. 2, P1, P2, P3 and P4 are used to correspondingly represent the reset phase, the compensation phase, the data writing phase and the light emitting phase respectively in the figure.

Figure 3:
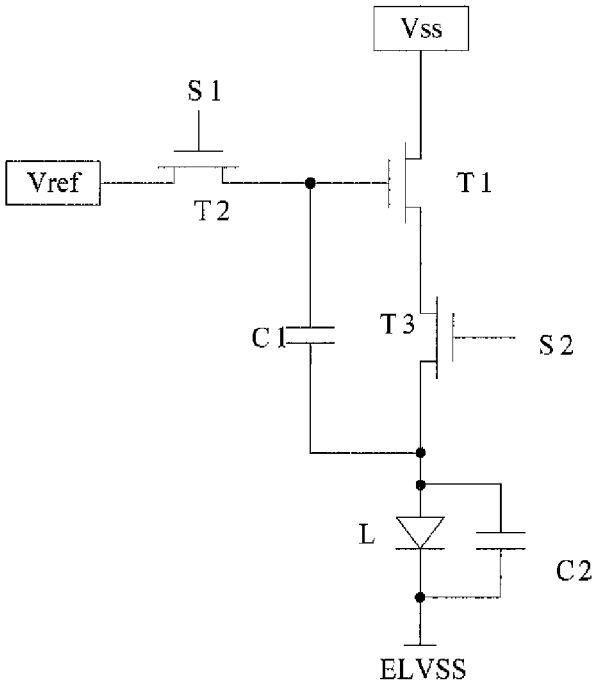
FIG. 3 is a schematic diagram of an equivalent circuit of a pixel circuit of an embodiment of the present disclosure in a reset phase.

Specifically, phase P1 is the reset phase whose equivalent circuit is shown in FIG. 3. In the reset phase, a high level are input into both the first control signal terminal S1 and the second control signal terminal S2, a low level (Vss) is input into the first power source signal terminal ELVDD, and a reset signal (Vref) of low level is input into the data signal terminal DATA, where Vref−Vth>Vss, and Vth is the threshold voltage of the transistor T1. At this time, the first transistor T1, the second transistor T2 and the third transistor T3 are turned on, the anode voltage of the light emitting device L is Vss, and the light emitting device L is in an OFF state.

Figure 4:
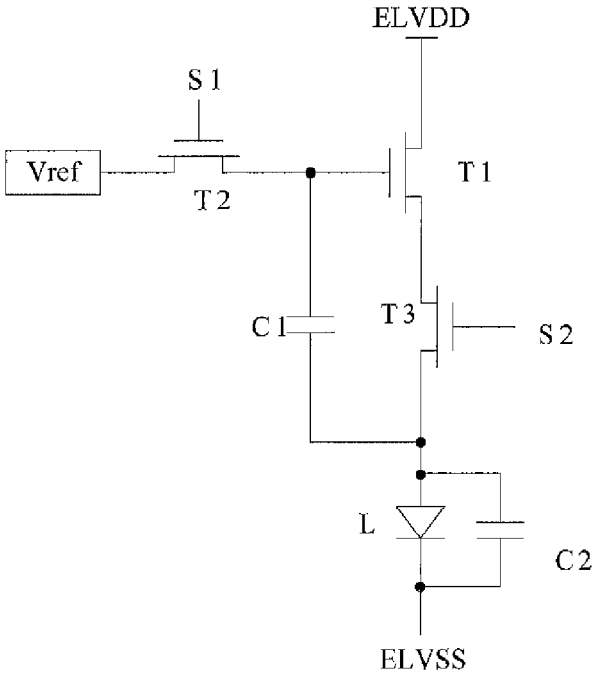
FIG. 4 is a schematic diagram of an equivalent circuit of a pixel circuit of an embodiment of the present disclosure in a compensation phase.

Phase P2 is the compensation phase whose equivalent circuit is shown in FIG. 4. In the compensation phase, the first control signal terminal S1, the second control signal terminal S2 and the first power source signal terminal ELVDD are all input with the high level, the data signal terminal DATA is input with the reset signal (Vref) of low level. At this time, the first transistor T1, the second transistor T2 and the third transistor T3 remain turned on, and the anode voltage of the light emitting device L increases with the charging of the first transistor T1 until the voltage equals to Vref-Vth. At the end of the compensation phase, the amount of charges stored across the storage capacitor C1 is $Vth \cdot C_{ST}$, where $C_{ST}$ is the capacitance of the storage capacitor C1.

Figure 5:
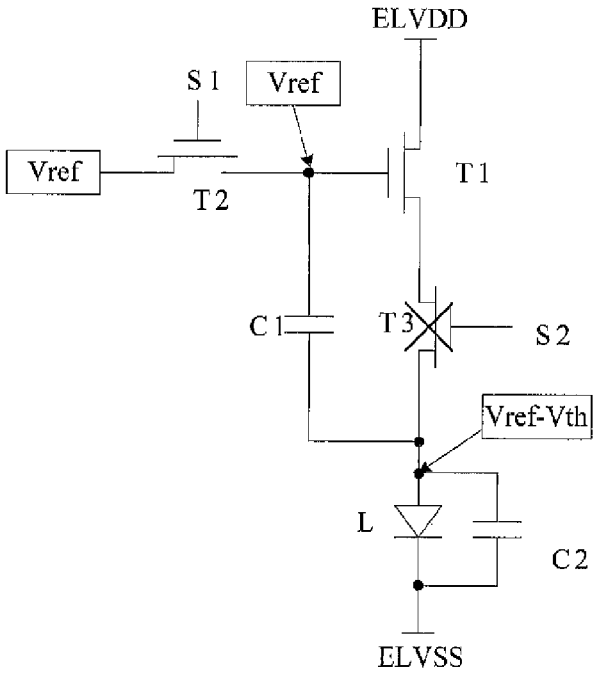
FIG. 5 is a schematic diagram of an equivalent circuit of a pixel circuit of an embodiment of the present disclosure before preparing to write data.
Figure 6:
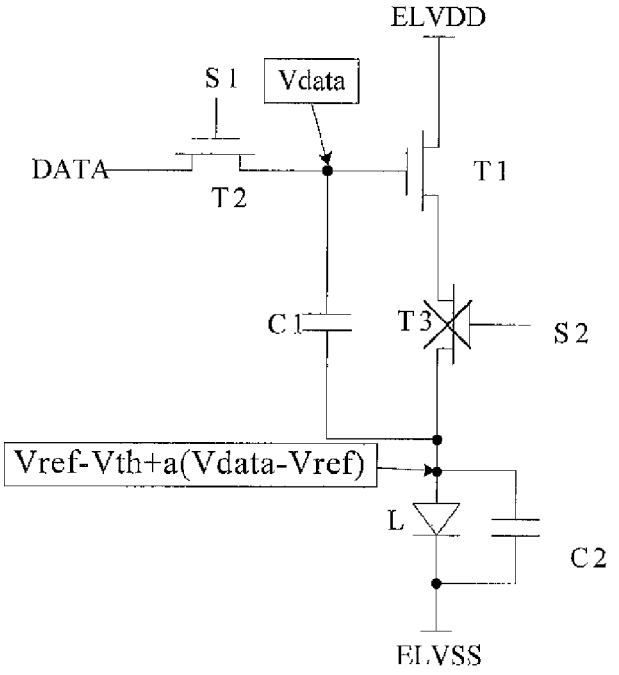
FIG. 6 is a schematic diagram of an equivalent circuit of a pixel circuit of an embodiment of the present disclosure in a data writing phase.

Phase P3 is the data writing phase. Specifically, before preparing to write data, it is needed to turn off the third transistor T3, and the equivalent circuit at this time is as shown in FIG. 5. The gate voltage of the first transistor T1 is the reset signal Vref of low level input by the data signal terminal DATA, and at this time, the anode voltage of the light emitting device L is Vref-Vth. During the data writing phase, the equivalent circuit is as shown in FIG. 6, wherein the first control signal terminal S1 and the first power source signal terminal ELVDD are both input with the high level, the second control terminal S2 is input with the low level, and the data signal terminal DATA is input with a data signal (Vdata) of high level. Therefore, the first transistor T1 and the second transistor T2 are turned on, the third transistor T3 is turned off, and at this time, the anode voltage of the light emitting device L beomes Vref−Vth+a(Vdata−Vref), where $a=C_{ST}/(C_{ST}+C_L)$, $C_L$ is the capacitance value of the parasitic capacitor C2.

Figure 7:
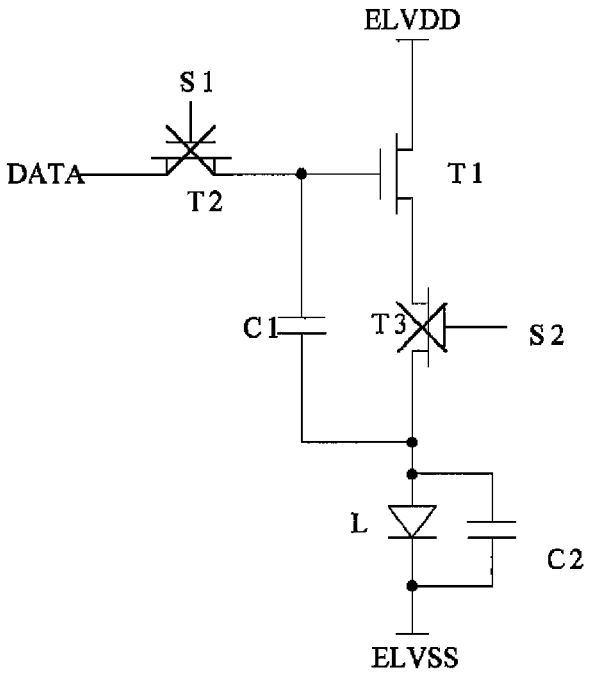
FIG. 7 is a schematic equivalent circuit diagram of a pixel circuit of an embodiment of the present disclosure before preparing to drive a light emitting device to emit light.
Figure 8:
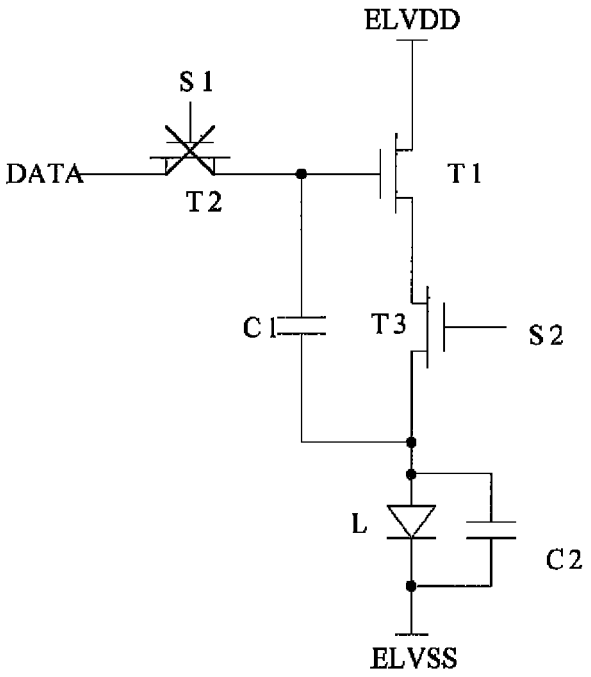
FIG. 8 is a schematic diagram of an equivalent circuit of a pixel circuit of an embodiment of the present disclosure in a light emitting phase.

Phase P4 is the light emitting phase. Specifically, before the pixel circuit is about to drive the light emitting device to emit light, the second transistor T2 needs to be turned off, and the equivalent circuit at this time is as shown in FIG. 7. During the light emitting phase, the first power source signal terminal ELVDD and the second control signal terminal S2 are both input with the high level, and the first control signal terminal S1 and the data signal terminal DATA are both input with the low level to turn on the third transistor T3. At this time, the equivalent circuit is as shown in FIG. 8, and the voltage Vgs between the gate and the source of the first transistor T1 is (1−a)(Vdata−Vref)+Vth.

The current flowing through the first transistor T1, the third transistor T3 and the light emitting device L in the light emitting phase is:

$$I_{OLED} = \frac{1}{2} \cdot \mu_n \cdot Cox \cdot \frac{W}{L} \cdot [(1-a)(V_{DATA} - Vref) + Vth - Vth]^2 = \frac{1}{2} \cdot \mu_n \cdot Cox \cdot \frac{W}{L} \cdot [(1-a)(V_{DATA} - Vref)]^2.$$

As can be seen from the above equation, the current for light emitting of the light emitting device L is irrelevant to both the TFT threshold voltage and the voltage across the two terminals of the OLED. Therefore, the influences of the nonuniformity or shift of the threshold voltages are effectively eliminated.

The pixel circuit with such a structure can compensate for the influences of the nonuniformity of the threshold voltages whether it is for an enhancement TFT or a depletion TFT, and thus has wider applicability. Simultaneously, such a structure uses fewer amounts of TFTs, has simple control signals, and thus is suitable for high resolution pixel design.

It should be noted that when the first transistor T1, the second transistor T2 and the third transistor T3 are all P type transistors, the timing of respective control signals can be inverse to the timing shown in FIG. 2, that is, their phase difference is 180 degrees.

Figure 9:
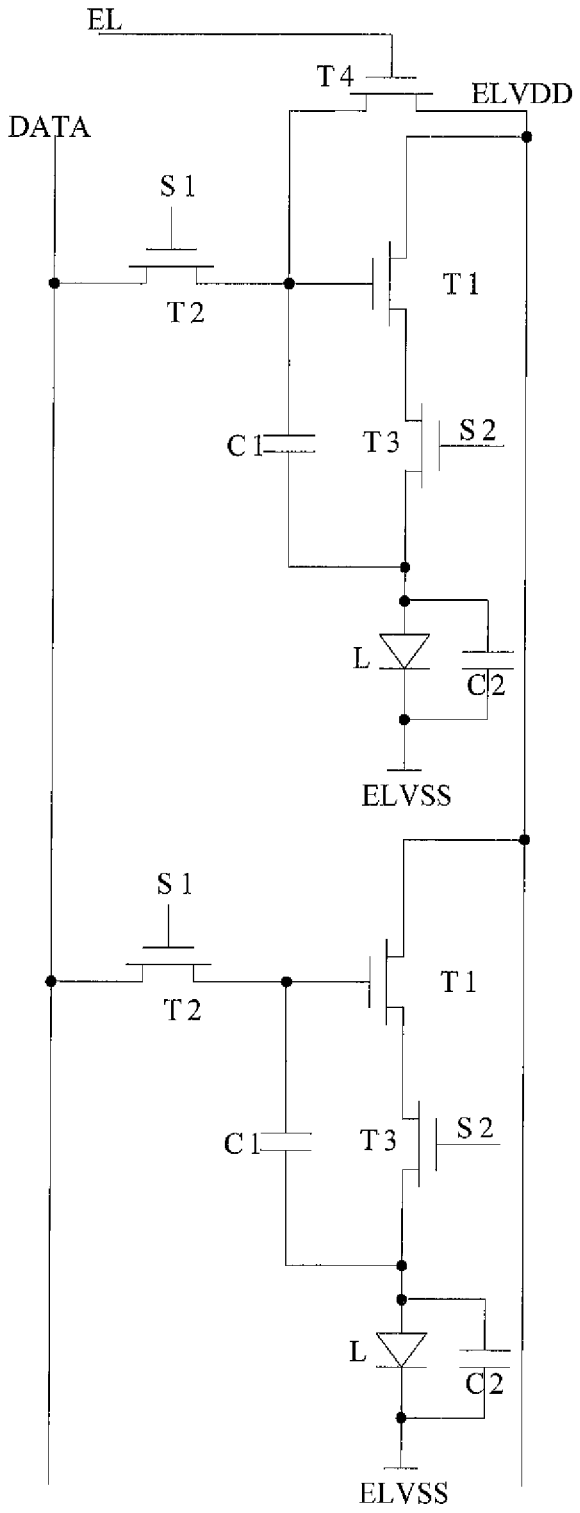
FIG. 9 is a schematic diagram of connection structure of another pixel circuit according to an embodiment of the present disclosure.

Further, as shown in FIG. 9, for one column of pixel circuits, the pixel circuit of an embodiment of the present disclosure can further comprise a fourth transistor T4 which can be located in the first pixel circuit of one column of pixel circuits. The gate of the fourth transistor T4 is connected to a control line EL, a first electrode of the fourth transistor T4 is connected to the second electrode of the second transistor T2, and a second electrode of the fourth transistor T4 is connected to the first power source signal terminal ELVDD.

In FIG. 9, each fourth transistor T4 can be corresponding to one column of pixel circuits. It is possible to further enhance the reliability of the control of the pixel circuit by one fourth transistor T4 controlling the control line EL to input signals to the first power source signal terminal ELVDD without adding additionally timing signal design.

In the pixel circuit of the embodiment of the present disclosure, the fourth transistor T4 can be an N type transistor or a P type transistor. Taking the N type transistor as an example, the N type transistors provided by an embodiment of the present disclosure can all be N type enhancement TFTs or N type depletion TFTs. Herein, the first electrodes of the first transistor T1, the second transistor T2, the third transistor T3 and the fourth transistor T4 can all refer to the drains, and the second electrodes thereof can all refer to the sources.

It should be noted that, the timing signal design as shown in FIG. 2 can also used to drive one column of pixel circuits as shown in FIG. 9. The difference is that the timing of the first power source signal terminal ELVDD is taken as the timing of the input signal of the control line EL. Adopting such a driving method which can also be divided into four phases, details can refer to the above embodiment and will not be described repeatedly here.

With a pixel circuit of such a structure, it is possible to make the current flowing through the transistors and used for driving the light emitting device irrelevant to the threshold voltage of the transistors by switching and charging/discharging control of the circuit through a plurality of transistors and capacitors, thereby compensating for the difference in current flowing through the light emitting devices due to inconformity or deviation of threshold voltages of the transistors, improving the uniformity of the light emitting brightness of the display apparatus, and dramatically raising the display effect. In addition, since the pixel circuit of such a structure has a simple structure and small amount of transistors, area of the light blocking region overlaying transistors can be reduced, and thus the aperture ratio of the display apparatus can be effectively increased.

It should be noted that, in the above embodiments, description is made by taking transistors being all enhancement N type TFTs as examples. Alternatively, it is also possible to adopt depletion N type TFTs. Their difference is that the threshold voltage Vth for the enhancement TFT is a positive value while the threshold voltage Vth for the depletion TFT is a negative value. In the above embodiments, the fourth transistor T4 can be an N type transistor or a P type transistor. The above description is made by taking the N type transistor as an example; however, the fourth transistor T4 can also adopt the P type transistor. When the fourth transistor T4 is a P type transistor, the timing of the control line EL can be inverse to the timing of ELVDD in the above FIG. 2, that is, their phase difference is 180 degrees.

An embodiment of the present disclosure also provides a display apparatus comprising an organic light emitting display, or other displays. The display apparatus comprises any pixel circuit as described in the above. The display apparatus can comprise a plurality of pixel unit arrays, and each pixel unit comprises any one pixel unit as described in the above. Optionally, as shown in FIG. 9, one fourth transistor T4 is corresponding to one column of pixel units. The display apparatus has the same beneficial effects as the pixel circuit provided in the above embodiments of the present disclosure. Since the pixel circuit has been described in detail in the above embodiment, it will not be described repeatedly here.

Specifically, the display apparatus of the embodiment of the present disclosure can a display apparatus with current-driving light emitting devices including a LED display or an OLED display.

The display apparatus according to the embodiment of the present disclosure comprises a pixel circuit. It is possible to make the current flowing through the transistors and used for driving the light emitting device irrelevant to the threshold voltage of the transistors by switching and charging/discharging control of the circuit through a plurality of transistors and capacitors, thereby compensating for the difference in current flowing through the light emitting devices due to inconformity or deviation of threshold voltages of the transistors, improving the uniformity of the light emitting brightness of the display apparatus, and dramatically raising the display effect. In addition, since the pixel circuit of such a structure has a simple structure and small amount of transistors, area of the light blocking region overlaying transistors can be reduced, and thus the aperture ratio of the display apparatus can be effectively increased.

Figure 10:
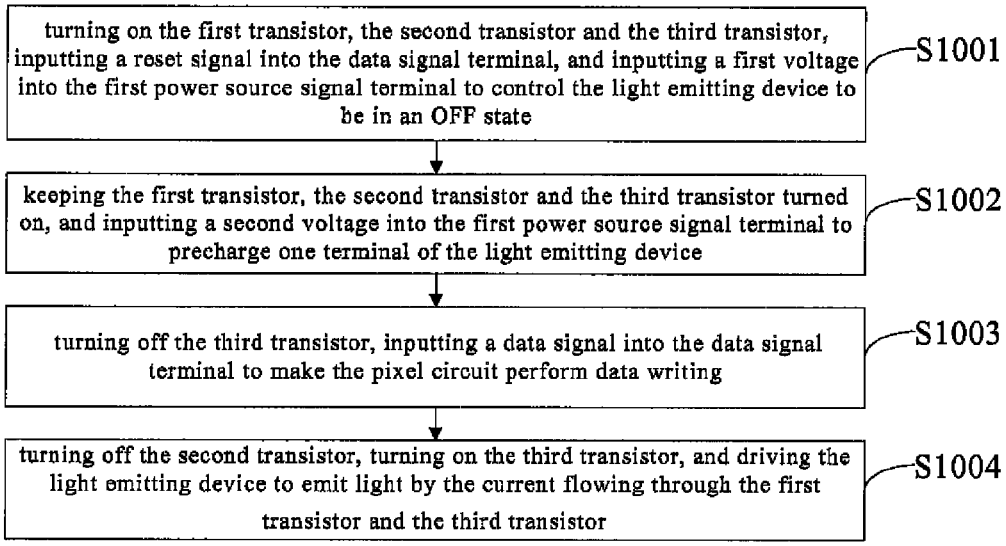
FIG. 10 is schematic flowchart of a driving method for a pixel circuit according to an embodiment of the present disclosure.

FIG. 10 is a schematic flowchart of a pixel circuit driving method according to an embodiment of the present disclosure. The pixel circuit driving method of the embodiment of the present disclosure can be applied to the pixel circuit provided in the above embodiments. As shown in FIG. 10, the method can comprise the following operations procedures:

in step S1001, turning on the first transistor, the second transistor and the third transistor, inputting a reset signal into the data signal terminal, and inputting a first voltage into the first power source signal terminal to control the light emitting device to be in an OFF state;

in step S1002, keeping the first transistor, the second transistor and the third transistor turned on, and inputting a second voltage into the first power source signal terminal to precharge one terminal of the light emitting device;

in step S1003, turning off the third transistor, inputting a data signal into the data signal terminal to make the pixel circuit perform data writing; and in step S1004, turning off the second transistor, turning on the third transistor, driving the light emitting device to emit light by the current flowing through the first transistor and the third transistor.

With the pixel circuit driving method of the embodiment of the present disclosure, it is possible to make the current flowing through the transistors and used for driving the light emitting device irrelevant to the threshold voltage of the transistors by switching and charging/discharging control of the circuit through a plurality of transistors and capacitors, thereby compensating for the difference in current flowing through the light emitting devices due to inconformity or deviation of threshold voltages of the transistors, improving the uniformity of the light emitting brightness of the display apparatus, and dramatically raising the display effect. In addition, since the pixel circuit of such a structure has a simple structure and small amount of transistors, area of the light blocking region of overlaying transistors can be reduced, and thus the aperture ratio of the display apparatus can be effectively increased.

It should be noted that the light emitting device in embodiments of the present disclosure can be various conventional current-driving light emitting devices including LED or OLED.

In an embodiment of the present disclosure, the signal input of the first power source voltage terminal can be controlled by the fourth transistor.

Specifically, one fourth transistor can be corresponding to one column of pixel circuits.

The gate of the fourth transistor is connected to a control line, a first electrode of the fourth transistor is connected to the first power source voltage terminal, and a second electrode of the fourth transistor is connected to the control power source line.

The fourth transistor can be an N type transistor or a P type transistor.

Further, in an embodiment of the present disclosure, the first transistor, the second transistor and the third transistor are all N type transistors; or the first transistor, the second transistor and the third transistor are all P type transistors.

It should be noted that when only the first transistor, the second transistor and the third transistor are included, and the first transistor, the second transistor and the third transistor are all N type transistors, the timing of control signals can be as shown in FIG. 2, comprising:

a first phase in which the first control signal terminal and the second control signal terminal are both input with a high level, the first power source signal terminal is input with a low level, and the data signal terminal is input with the reset signal of low level;

a second phase in which the first control signal terminal, the second control signal terminal and the first power source signal terminal are all input with the high level, and the data signal terminal is input with the reset signal of low level;

a third phase in which the first control signal terminal and the first power source signal terminal are both input with the high level, the second control signal terminal is inputted with the low level, and the data signal terminal is input with the data signal of high level; and a fourth phase in which the first power source signal terminal and the second control signal terminal are both input with the high level, and the first control signal terminal and the data signal terminal are both input with the low level.

Specifically, when the first transistor, the second transistor and the third transistor are all N type enhancement transistors, the step S1001 can comprise specifically:

inputting a high level into both the first control signal terminal S1 and the second control signal terminal S2, inputting a low level (Vss) into the first power source signal terminal ELVDD, and inputting the reset signal (Vref) of low level into the data signal terminal DATA, where Vref−Vth>Vss, and Vth is the threshold voltage of the transistor T1.

Herein, this step is the reset phase. As shown in FIG. 2, in the reset phase (P1), the first control signal terminal S1 and the second control signal terminal S2 are both input with the high level, the first power source signal terminal ELVDD is input with the low level (Vss), and the data signal terminal DATA is input with the reset signal (Vref) of low level. At this time, the first transistor T1, the second transistor T2 and the third transistor T3 are turned on, the anode voltage of the light emitting device L is Vss, and the light emitting device L is in the OFF state.

Accordingly, the step S1002 can comprise: inputting the high level into all of the first control signal terminal S1, the second control signal terminal S2 and the first power source signal terminal ELVDD, and is inputting the reset signal of low level (Vref) into the data signal input terminal DATA.

This step is the compensation phase. At this time, the first transistor T1, the second transistor T2 and the third transistor T3 remain turned on, and the anode voltage of the light emitting device L increases with the charging of the first transistor T1 until the voltage equals to Vref-Vth. At the end of the compensation phase, the amount of charges stored at the two terminals of the storage capacitor C1 is $Vth \cdot C_{ST}$, where $C_{ST}$ is the capacitance of the storage capacitor C1.

The step S1003 can comprise: before preparing to write data, requesting to turn off the third transistor T3, the equivalent circuit at this time is as shown in FIG. 5, the gate voltage of the first transistor T1 is the reset signal Vref of low level input by the data signal terminal DATA, and at this time, the anode voltage of the light emitting device L is Vref−Vth.

This step is the data writing phase. During this phase, the first control signal terminal S1 and the first power source signal terminal ELVDD are both input with the high level, the second control signal terminal S2 is input with the low level, and the data signal terminal DATA is input with a data signal (Vdata) of high level. At this time, the first transistor T1 and the second transistor T2 are turned on, the third transistor T3 is turned off, and the anode voltage of the light emitting device L beomes Vref−Vth+a(Vdata−Vref), where $a=C_{ST}/(C_{ST}+C_L)$, $C_L$ is the capacitance of the parasitic capacitor C2.

The step S1004 can comprise: before preparing to drive the light emitting device to emit light by the pixel circuit, requesting the second transistor T2 to be turned off.

This step is the light emitting phase. During this phase, the first power source signal terminal ELVDD and the second control signal terminal S2 are both input with the high level, and the first control signal terminal S1 and the data signal terminal DATA are both input with the low level to turn on the third transistor T3. At this time, the voltage Vgs between the gate and the source of the first transistor T1 is (1−a)(Vdata−Vref)+Vth.

The current flowing through the first transistor T1, the third transistor T3 and the light emitting device L in the light emitting phase is:

$$I_{OLED} = \frac{1}{2} \cdot \mu_n \cdot Cox \cdot \frac{W}{L} \cdot [(1-a)(V_{DATA} - Vref) + Vth - Vth]^2 = \frac{1}{2} \cdot \mu_n \cdot Cox \cdot \frac{W}{L} \cdot [(1-a)(V_{DATA} - Vref)]^2.$$

As can be seen from the above equation, the current for light emitting of the light emitting device L is irrelevant to both the TFT threshold voltage and the voltage across the two terminals of the OLED; therefore, the influences of the nonuniformity or shift of the threshold voltages are effectively eliminated.

The pixel circuit with such a structure can compensate for the influences of the nonuniformity of the compensation threshold voltages whether for the enhancement TFT or the depletion TFT, and thus has wider applicability. Simultaneously, such a structure uses less amount of TFTs, has simple control signals, and thus is suitable for high resolution pixel design.

Alternatively, when the first transistor, the second transistor, the third transistor and the fourth transistor are all N type transistors, the timing of control signals can also be as shown in FIG. 2, which comprises:

a first phase in which the control line and the second control signal terminal are both input with a high level, the first power source signal terminal is input with a low level, and the data signal terminal is input with the reset signal of low level;

a second phase in which the control line, the second control signal terminal and the first power source signal terminal are all input with the high level, and the data signal input terminal is input with the reset signal of low level;

a third phase in which the control line and the first power source signal terminal are both input with the high level, the second control signal terminal is inputted with the low level, and the data signal terminal is input with the data signal with high level; and a fourth phase in which the first power source signal terminal and the second control signal terminal are both input with the high level, and the control line and the data signal terminal are both input with the low level.

It should be noted that, the timing signal design as shown in FIG. 2 can also used to drive one column of pixel circuits as shown in FIG. 9. The difference is that the timing of the first power source signal terminal ELVDD is taken as the timing of the input signal of the control line EL. Such a driving method can also be divided into four phases whose details can refer to the above embodiment and will not be described repeatedly here.

It can be understood by those skilled in the art that all or part of the process flows for implementing the above method embodiments can be realized by computer programs instructing related hardware. The above programs can be stored in a computer readable storage medium. When being executed, the programs perform the steps comprising the above method embodiments. The above-mentioned storage medium can comprise various media that can store program codes such as ROM, RAM, magnetic disks, optical disks or the like.

The above descriptions are only specific implementations of the present disclosure, but the protection scope of the present disclosure is not limited to that. Variations or replacements that can be easily devised by those skilled in the art within the technical scope disclosed by the present disclosure should all fall within the protection scope of the present disclosure. Therefore, the protection scope of the present disclosure should be defined by the protection scope of the claims.

The present application claims the priority of Chinese Patent Application No. 201310683964.6 filed on Dec. 12, 2013, entire content of which is incorporated as part of the present application by reference.

What is claimed is:

1. A pixel circuit, wherein the pixel circuit comprises a first transistor, a second transistor, a third transistor, a storage capacitor, a parasitic capacitor and a light emitting device;

a first electrode of the first transistor is connected to a first power source signal terminal, and a second electrode of the first transistor is connected to a first electrode of the third transistor;

a gate of the second transistor is connected to a first control signal terminal, a first electrode of the second transistor is connected to a data signal terminal, and a second electrode of the second transistor is connected to a gate of the first transistor;

a gate of the third transistor is connected to a second control signal terminal, and a second electrode of the third transistor is connected to one terminal of the light emitting device;

one terminal of the storage capacitor is connected to the gate of the first transistor, and the other terminal of the storage capacitor is connected to one terminal of the light emitting device;

one terminal of the parasitic capacitor is connected to one terminal of the light emitting device, and the other terminal of the parasitic capacitor is connected to the other terminal of the light emitting device;

the other terminal of the light emitting device is also connected to a second power source signal terminal;

the pixel circuit further comprises only one fourth transistor corresponding to one column of pixel circuits; and a gate of the one fourth transistor is connected to a control line, a first electrode of the one fourth transistor is connected to the second electrode of the second transistor, and a second electrode of the one fourth transistor is connected to the first power source signal terminal;

wherein the one fourth transistor is controlled by the control line to input signals to the first power source signal terminal.

2. The pixel circuit of claim 1, wherein the fourth transistor is an N type transistor or a P type transistor; and the first electrode of the fourth transistor is a drain, and the second electrode of the fourth transistor is a source.

3. The pixel circuit of claim 1, wherein the first transistor, the second transistor and the third transistor are all N type transistors; or the first transistor, the second transistor and the third transistor are all P type transistors; and the first electrodes of the first transistor, the second transistor and the third transistor are all drains, and the second electrodes of the first transistor, the second transistor and the third transistor are all sources.

4. A display apparatus comprising the pixel circuit according to claim 1.

5. The display apparatus of claim 4, wherein the fourth transistor is an N type transistor or a P type transistor; and the first electrode of the fourth transistor is the drain, and the second electrode of the fourth transistor is the source.

6. The display apparatus of claim 4, wherein the first transistor, the second transistor and the third transistor are all N type transistors; or the first transistor, the second transistor and the third transistor are all P type transistors; and the first electrodes of the first transistor, the second transistor and the third transistor are all drains, and the second electrodes of the first transistor, the second transistor and the third transistor are all sources.

* * * * *